United States Patent [19]

Rubashev et al.

[11] 4,112,348

[45] Sep. 5, 1978

[54] CONTACTLESS SWITCH FOR REGULATING TAPS OF INDUCTION ELECTRIC MACHINES

[76] Inventors: Grigory Markovich Rubashev, V.O. 15 Linia, 34, kv. 37; Vladislav Ruvimovich Alperovich, ulitsa Dybenko, 27, korpus 3, kv. 22; Jury Iosifovich Lazovsky, poselok Pesochnaya, ulitsa Sovetskaya, 26, all of Leningrad, U.S.S.R.

[21] Appl. No.: 754,680

[22] Filed: Dec. 27, 1976

[51] Int. Cl.[2] ..... G05F 1/20

[52] U.S. Cl. ..... 323/43.5 S; 323/47; 323/75 E

[58] Field of Search ..... 323/43.5 S, 45, 47, 323/62, 75 E; 363/128

[56] References Cited

U.S. PATENT DOCUMENTS

| | | | |
|---|---|---|---|
| 3,700,925 | 10/1972 | Wood | 323/43.5 S |
| 3,890,557 | 6/1975 | Bogdanov et al. | 323/43.5 S |
| 3,919,619 | 11/1975 | Corry | 323/43.5 S |
| 3,953,781 | 4/1976 | Forster et al. | 363/128 X |
| 4,021,721 | 5/1977 | Tachibana | 363/128 |

*Primary Examiner*—A. D. Pellinen

*Attorney, Agent, or Firm*—Lackenbach, Lilling & Siegel

[57] ABSTRACT

A contactless current regulating and limiting device for power supply systems includes a switch composed of four-arm bridges built around controlled and uncontrolled gates connected to regulating taps, each of the regulating taps being connected to the load by four-arm bridges of the switch, the controlled gates making up two arms of the switch, whereas the other two arms thereof are the uncontrolled gates which are common for all the taps, there being placed a reactor in the diagonal of the bridge. A d.c. source may be connected in series with the reactor.

6 Claims, 2 Drawing Figures

CONTACTLESS SWITCH FOR REGULATING TAPS OF INDUCTION ELECTRIC MACHINES

Figure 1:
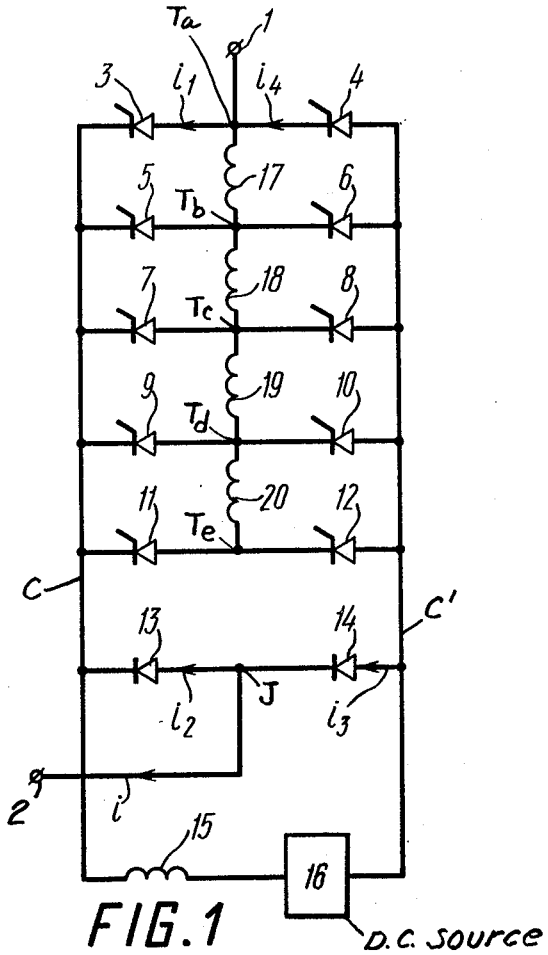

The present invention relates to switching means for transformers and, more particularly, to contactless current regulators and limiters for power supply systems.

The invention is applicable to voltage regulating systems of power and industrial transformers. It can be used, for example, to regulate the power of arc and ore furnaces. Finally, as a current regulator and limiter, the invention is applicable to power supply systems.

As far as power systems are concerned, it is extremely important to provide contactless current regulators and limiters for such systems. However, the provision of such devices involves a number of technological difficulties. On the one hand, it is necessary to provide a device with a simple switching algorithm. On the other hand, it is desirable that the parameters of the gate elements should be calculated only with regard to the rated duty of an apparatus or installation. The gate elements are to be reliably protected in emergency conditions.

There are known contactless regulation devices comprising gate-type groups of thyristors connected to taps of a transformer. Such groups are either directly connected to the taps (cf. GDR Pat. No. 68,034, related to a device for regulating load voltage of multicircuit transformers), or are connected to the taps through four-arm bridges (cf. USSR Inventor's Certificate No 312,362, related to an a.c. voltage regulator).

According to GDR Patent Specification No 68,034, the switching is done through the use of a group of active resistors which limit the current as a coil is closed. According to USSR Inventor's Certificate No 312,362, the switching is done at a moment the current of a thyristor group being disconnected crosses the zero point.

The known devices under review have a number of disadvantages, including the following:

1. The dependence of the switching algorithm upon the nature of the load (cf. USSR Inventor's Certificate No 312,362).

This badly affects the reliability of switching devices and may lead to short-circuiting or circuit breaking in case of a mulfunction of the control system.

2. The presence of a large number of current-limiting resistors (cf. GDR Pat. No. 68,034), which drawback is especially pronounced in multiple switches.

3. The necessity of selecting gate-type elements with due regard for the fact that the first shock wave of short circuit current passes through these gate-type elements, the latter disadvantage being typical of both prototypes under consideration and accounting for an increased size and weight, as well as increased production cost of such devices.

4. The impossibility of combining the current regulation function with the function of limiting the surge current in case of a breakdown in the power supply system.

It is an object of the present invention to provide a static commutation device which would have no effect upon the operating conditions of a power system as long as the latter operates normally.

It is another object of the invention to enable the foregoing device to commutate tapping steps of a power transformer irrespective of operating conditions of the power system, such as the power direction, type of load, etc.

It is still another object of the invention to provide the foregoing device with means to protect the thyristors from short circuit currents and overvoltages and make it possible to select the number of gates only with regard to the rated duty of the installation or apparatus.

It is yet another object of the invention to provide a device with a single common current-limiting element which would make it possible to limit the current load on the gates of the device and, if necessary, limit the current through the power supply system.

The foregoing and other objects of the present invention are attained by providing a contactless current regulating and limiting device for power supply systems, comprising a switch composed of four-arm bridges built around controlled and uncontrolled gates connected to regulating taps, in which device each of the regulating taps is connected, in accordance with the invention, to the load by means of said four-arm bridges of the switch, whereof two arms are the controlled gates, the other two arms being the uncontrolled gates which are common for all the taps, there being placed a reactor in the diagonal of the bridge.

It is expedient that there also be placed in the diagonal of the bridge, in series with the reactor, a d.c. source.

The foregoing design makes it possible to rapidly switch the taps of the power transformer irrespective of the type of load, protect the gates from short-circuit currents in emergency situations, and limit the current through the power supply system.

The invention accounts for considerable economy which is due to the following factors:

(a) the possibility of selecting gate elements of the switch only with regard to the rated current, because in an emergency situation the first current half-wave is limited;

(b) the provision of a high-speed switch with a common current limiter for all the steps:

(c) the provision of a regulator which also commutates high powers, including those that cannot be commutated by conventional electromechanical equipment due to limiting the shock wave of short circuit current.

In turn, the foregoing factors make it possible to build power supply systems with great short circuit power, raise the carrying capacity of power supply systems, and improve the operation of power distribution networks.

Figure 2:
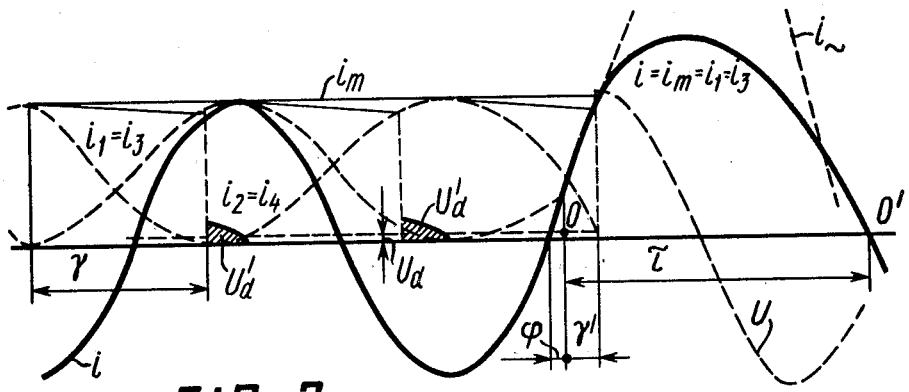

Other objects and advantages of the present invention will become more apparent from the following detailed description of a preferred embodiment thereof to be read in conjunction with the accompanying drawings, wherein:

FIG. 1 is a schematic diagram of a contactless current regulating and limiting device for power supply systems, in accordance with the invention; and FIG. 2 presents curves of instantaneous current and voltage values in the course of operation of the device in accordance with the invention.

The device of this invention can be built for an arbitrarily chosen number of taps. FIG. 1 shows an embodiment of the device intended for a transformer whose regulation zone has five taps. In FIG. 1, the reference numerals designate the following units: 1 and 2 are regulation zone taps; C,C' are electrical conductors; 3 through 12 are thyristors, 13 and 14 are uncontrolled gates in the nature of diodes or rectifiers, 15 is a reactor, and 16 is a d.c. source connected to the electrical conductors as shown; and 17 through 20 are coils the terminals of which define tapping steps or taps $T_a$, $T_b$, $T_c$, $T_d$ and $T_e$. The diodes 13 and 14 are series-connected as shown to form a junction point J.

As is seen from FIG. 1, the gate elements of the switch make up single-phase bridge circuits whose two arms are the thyristors 3 and 4, 5 and 6, 7 and 8, 9 and 10, 11 and 12, respectively. The uncontrolled gates 13 and 14 make up the two other arms which are common for all the regulation zones. The reactor 15 and d.c. source 16 are placed in the diagonal of said bridge rectifiers. The source 16 is not an essential component of the device.

If the reactor 15 has a high Q-factor, the d.c. source 16 can be dispensed with.

The proposed device operates as follows.

The circuit is closed upon applying control pulses to any pair of the thyristors 3 and 4, 5 and 6, etc. At a moment when positive voltage appears across said thyristors, the regulation angle is zero. Across the diagonal of the bridge, there appears rectified voltage, due to which the current in the reactor 15 reaches the amplitude value of the load current (FIG. 2). Passing through the reactor 15 is rectified current formed from the currents $i_1$, $i_2$, $i_3$, $i_4$ of the bridge's arms. If the reactor 15 has a high Q-factor, all the four gates 3, 4, 11, 12 of the bridge conduct current, and the commutation angle of the rectifier is equal to 180°. The gates' currents have a constant component which is equal to one half of the maximum value of the load current $i_m$, and a sinusoidal component with an amplitude ($i_m/2$).

The load current takes the following path: from the tap 1, the forward wave proceeds through the coils 17, 18 and 19, the thyristor 9, the reactor 15, the d.c. source 16 (if the latter is incorporated into the circuitry), and the diode 14 to the tap 2. The backward wave of the working current goes from the tap 2 through the diode 13, the reactor 15, the source 16, the thyristor 10, the coils 19, 18 and 17 to the tap 1. The load current follows a similar path if the switch is positioned for other taps.

In the actual circuitry, the thyristors 3 through 12, the uncontrolled gates 13 and 14 and the reactor 15 U'a finite resistance value, so within the commutation angle $\gamma$ the current $i_m$ in the reactor is damped (FIG. 2). As a result, there apperar intercommutation intervals in the operation of the switching device, when the reactor 15 is connected in the circuit between the gates.

Such an interval can constitute several electrical degrees; as a result, across the reactor 15 there appear unipolar voltage surges u'$\alpha$. Such voltage surges have small effect upon the operating conditions because their mean values are small. The mean value of the voltage drop $U_d$ across the switching device is determined by the sum total of voltage drops across the active resistance of the reactor and the gates.

If necessary, it is also possible with the device of this invention to completely eliminate said voltage drop. For this purpose, the circuit incorporates the d.c. source 16 which is placed in series with the reactor 15. The d.c. source 16 is fed from the common mains.

Switching from one tap to another can be carried out at any moment of time, for which purpose control pulses are removed from the operating group of thyristors and applied to any adjacent group. For example, when the thyristors 11 and 12 are connected to the circuit and the working current flows through the entire regulation zone of the power transformer's winding, the switching to the adjacent tap at an arbitrarily chosen moment "O" (FIG. 2) is done by applying control pulses from the thyristors 11 and 12 to the thyristors 9 and 10. As indicated above, at this moment the working current flows through the thyristors 11 and 12 and the uncontrolled gates 13 and 14. As the thyristors 9 and 10 are connected into the circuit, there is formed a short circuiting loop of the coil 20. Said short circuiting loop incorporates the thyristor 11, the uncontrolled gate 13, the reactor 15 and the thyristor 10. The short-circuit current reaches the amplitude value of the reactor current over the time interval $\gamma'$, after which one of the thyristors 11 or 12 (in this case, the thyrsitor 12) is disconnected, and the reactor 15 is connected into the short-circuiting loop and limits the current magnitude to a required value. The switching process is ended over a period of time $\tau$ at the moment of natural commutation of the thyristor 11.

The switching to any other tap is done in a similar manner. The circuitry allows of commutation between any two taps. As pointed out above, the d.c. source 16 is included in the circuitry in case the Q-factor of the reactor 15 is not high enough. The use of the d.c. source 16 completely eliminates the effect of the circuitry upon the operating conditions of the power supply system.

In case of an external short circuit, the proposed device's current-limiting mode of operation is similar to the tap switching mode. FIG. 2 shows a current limiting cycle with the short circuit angle $\phi$ and the expected short circuit current $i_{\sim}$.

As is seen from FIG. 2, the reactor 15 is parametrically included in the circuitry during the first half-period of the fault current. The reactor 15 limits the current half-wave over a period of time 00' which is lesser than the frequency period of the network. As a result, there is a voltage drop U across the reactor 15. The extent to which the current is limited is determined by the parameters of the reactor 15, which have to be appropriately selected.

What is claimed is:

1. A contactless switch for regulating taps of inductive electric machines, comprising a plurality of series-connected induction machine coils the terminals of which define a plurality tapping steps or taps: a pair of electrical conductors; a pair of controlled gates connected between each of said taps and another one of said electrical conductors; a pair of uncontrolled gates connected in series to each other to form a junction point and connected to said electrical conductors; and a reactor connected between said electrical conductors, said gates being arranged to form one of a plurality of single-phase bridge circuits when a pair of controlled gates are rendered conductive, each bridge circuit comprising one pair of said controlled gates which form two arms of a respective bridge circuit, said uncontrolled gates being common to all bridge circuits and forming the other two arms thereof, and said reactor being disposed in the diagonals of said bridge circuits, whereby a load may be connected to a desired tap by one of said bridge circuits by actuation of a selected pair of said controlled gates.

2. A device as defined in claim 1, wherein said controlled gates are thyristors.

3. A device as defined in claim 1, wherein said uncontrolled gates are diodes or rectifiers.

4. A device as defined in claim 1, further comprising a d.c. source connected in series with said reactor between said electrical conductors.

5. A device as defined in claim 1, wherein five taps are provided.

6. A device as defined in claim 1, wherein the input terminals to each bridge include said junction point and an end tap of said induction machine coils.

* * * * *